US007182717B2

(12) United States Patent
Tanglos

(10) Patent No.: US 7,182,717 B2
(45) Date of Patent: Feb. 27, 2007

(54) THERAPY CUSHION FOR USE WITH BLOOD PRESSURE CUFF

(76) Inventor: Thomas Alexander Tanglos, 6889 Caravan Ct., Columbia, MD (US) 21044

( * ) Notice: Subject to any disclaimer, the term of this patent is extended or adjusted under 35 U.S.C. 154(b) by 461 days.

(21) Appl. No.: 10/819,561

(22) Filed: Apr. 7, 2004

(65) Prior Publication Data

US 2004/0198570 A1 Oct. 7, 2004

Related U.S. Application Data

(60) Provisional application No. 60/461,066, filed on Apr. 7, 2003.

(51) Int. Cl.
*A63B 21/008* (2006.01)

(52) U.S. Cl. ..... 482/112; 482/121; 482/139

(58) Field of Classification Search ..... 482/112, 482/139, 121, 148; 5/664, 639, 640, 635.3; 128/845; 602/13
See application file for complete search history.

(56) References Cited

U.S. PATENT DOCUMENTS

| | | | | |
|---|---|---|---|---|
| 2,522,120 | A * | 9/1950 | Kaskey et al. | 5/636 |
| 4,528,705 | A * | 7/1985 | Greenawalt | 5/644 |
| 4,772,016 | A * | 9/1988 | Manion | 482/112 |
| 5,005,826 | A * | 4/1991 | Merrick | 482/10 |
| 5,895,366 | A * | 4/1999 | Bzoch | 602/24 |
| 6,327,725 | B1 * | 12/2001 | Veilleux et al. | 5/644 |
| 6,371,894 | B1 * | 4/2002 | Hill | 482/121 |
| 6,413,194 | B1 * | 7/2002 | Gant | 482/112 |

* cited by examiner

*Primary Examiner*—Jerome Donnelly
(74) *Attorney, Agent, or Firm*—Ober/Kaler; c/o Royal W. Craig

(57) ABSTRACT

Disclosed herein is a novel therapy cushion for use in conjunction with a conventional blood pressure cuff. The cuff is inserted into the cushion, and the cushion with inserted cuff is placed between the legs (or against one leg). The cuff is inflated and used as calibrated resistance training device for therapeutic/rehabilitation purposes. The device is especially effective following hip or knee replacement surgery. The manometer (on the blood pressure cuff) serves to indicate resistance level. Other variations are possible for other exercises.

20 Claims, 13 Drawing Sheets

THERAPY CUSHION FOR USE WITH BLOOD PRESSURE CUFF

CROSS-REFERENCE TO RELATED APPLICATIONS

The present application derives priority from U.S. Provisional Patent Application TANGLOS-PPA-1 New U.S. Provisional Patent Application No. 60/461,066 filed: Apr. 7, 2003.

BACKGROUND OF THE INVENTION

1. Field of the Invention

The present invention relates to exercise equipment and, more particularly, to a therapy cushion that integrates with a convention blood pressure meter for calibrated physical therapy and rehabilitation.

2. Description of the Background

Knee and hip injuries and the associated surgical operations frequently necessitate a prolonged regimen of physical therapy afterward. There are a variety of exercises and exercise devices used to rehabilitate a joint. The exercise devices must be carefully calibrated and provide feedback as to the exercise performance.

The monitoring of patients is necessary during physiotherapy exercises to ensure that the patient is carrying out the exercises in the prescribed fashion, and to avoid muscle fatigue, strain, and pain. Monitoring of the exercises is also necessary so that an attending therapist can keep track of progress.

As an example, motor driven rails permit rotation of a lower leg receptacle relative to a thigh receptacle. This produces a knee-joint, movement, substantially free of any weight loads, so that the mobility of the knee joint can be trained without any damaging weight loads on the ligaments. The disadvantage of the known motor-driven rail is twofold. One, a motor drive is required to calibrate the exercise (and to provide feedback) and two, the healthy leg is not involved in the movement (in the case of prolonged rehabilitation this can cause weakening and impairment of the healthy leg). The motors and electronics used in these motor-driven rails make them expensive, space-consuming, and difficult to operate even by trained individuals. There are also a variety of cable pull and other arrangements fraught with the same disadvantages.

In light of the above, there remains a significant commercial need for a simple, more compact exercise device that nevertheless provides accurate calibrated exercise and feedback.

Sphygmomanometers are well known instruments for the measurement of arterial blood pressure. These devices typically comprise a pressure bulb with suitable valves associated therewith, an elongate cuff usually having velcro attachments for fastening to an arm or leg and a pressure bag or bladder usually formed from resilient material retained within a retaining pocket in the elongate cuff. A first air hose connects the bulb with the bladder, and a second air hose connects the bladder with a suitable metering device. The metering devices may include an analog meter (e.g. mercury manometer or aneroid dial) or digital read out. These sphygmomanometers are very accurate and comparatively inexpensive pneumatic monitoring devices, and yet they are solely used for measurement of arterial blood pressure.

There would be significant demand for a physical therapy exercise device for hip, knee, and other joint exercises that incorporates an existing sphygmomanometer to provide accurate calibrated feedback suitable for monitoring progress of physiotherapy exercises. A plurality of straps are attached to the cushion for securement to body parts and for stretching.

SUMMARY OF THE INVENTION

It is, therefore, the primary object of the present invention to provide an improved physical therapy exercise device for the rehabilitation of hips, knees, and other joints that incorporates an existing sphygmomanometer in a contoured cushion for accurate calibrated feedback to measure the administration and to monitor the progress of physiotherapy exercises.

It is another object to provide a physical therapy exercise device that is small/compact and inexpensive.

It is another object to provide a physical therapy exercise device having a particular external configuration that permits a variety of rehabilitation exercises for hips, knees, and other joints, and with a particular internal configuration that allows use with a conventional sphygmomanometer to measure the administration and to monitor the progress of the physiotherapy exercises.

It is another object to provide a physical therapy exercise device as described above having an array of straps attached to the contoured cushion for securement to body parts and for stretching.

These and other objects are accomplished by a therapy cushion for the rehabilitation of hips, knees, and other joints that integrates with an existing sphygmomanometer for accurate calibrated feedback to measure the administration and to monitor the progress of physiotherapy exercises. In a preferred embodiment, the therapy cushion comprises a resilient pad having an hourglass cross-section and a central pocket for the insertion of the cuff a conventional sphygmomanometer. In use, a therapist inserts the cuff into the therapy cushion and inflates the cuff via the bulb to a prescribed baseline pressure. Then, the patient is required to complete a repetitive set of exercises which compress the therapy cushion, thereby increasing the pressure readout from baseline to maximum achieved and back.

The therapy cushion/sphygmomanometer combination provides for a wide variety of rehabilitation exercises for hips, knees, and other joints, improves the accuracy of calibrated physiotherapy exercise monitoring, and yet is small/compact and inexpensive.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figure 1:
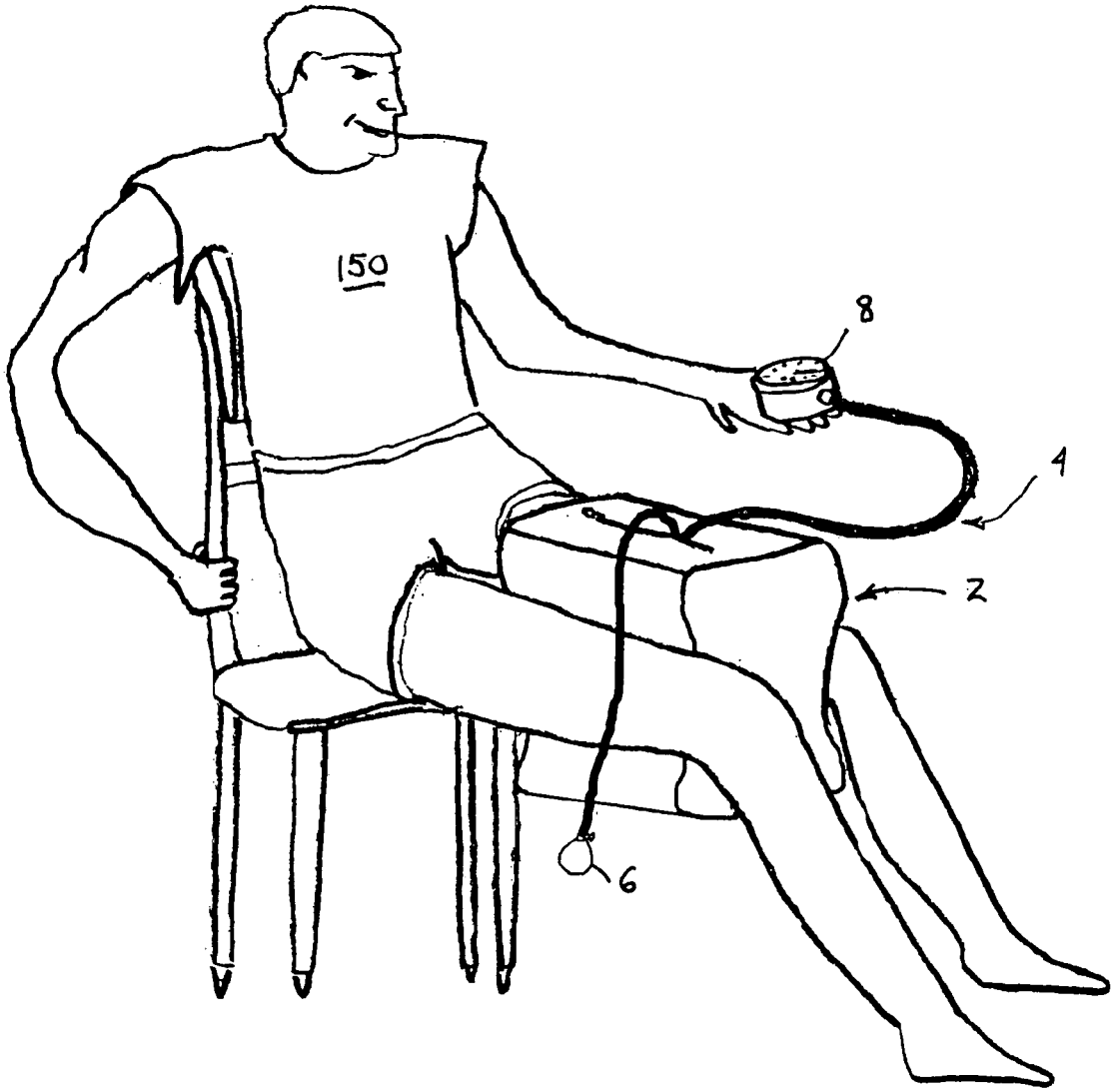
FIG. 1 is a side perspective drawing illustrating the therapy cushion 2 in use with a sphygmomanometer 4 according to a preferred embodiment of the present invention.

FIG. 1 is a side perspective drawing illustrating the therapy cushion 2 in use with a sphygmomanometer 4 according to a preferred embodiment of the present invention. The therapy cushion 2 has a particular external contoured shape that makes it well-suited for a variety of rehabilitation exercises for hips, knees, and other joints. In addition, the therapy cushion 2 has a particular internal configuration that allows easy insertion of the cuff of a conventional sphygmomanometer 4 (leaving bulb 6 and meter 8 outwardly accessible) to measure the administration and to monitor the progress of the physiotherapy exercises. Thus, in use, the patient themselves or an attending therapist can easily administer the exercise by inflating the cuff 7 (see FIG. 2) via the bulb 6 to a prescribed baseline pressure as indicated on the meter 8, and then requiring the patient 150 to complete a repetitive set of exercises which compress the therapy cushion 2 by a specified pressure, thereby increasing the pressure readout on the meter 8 from baseline to maximum achieved.

Figure 2:
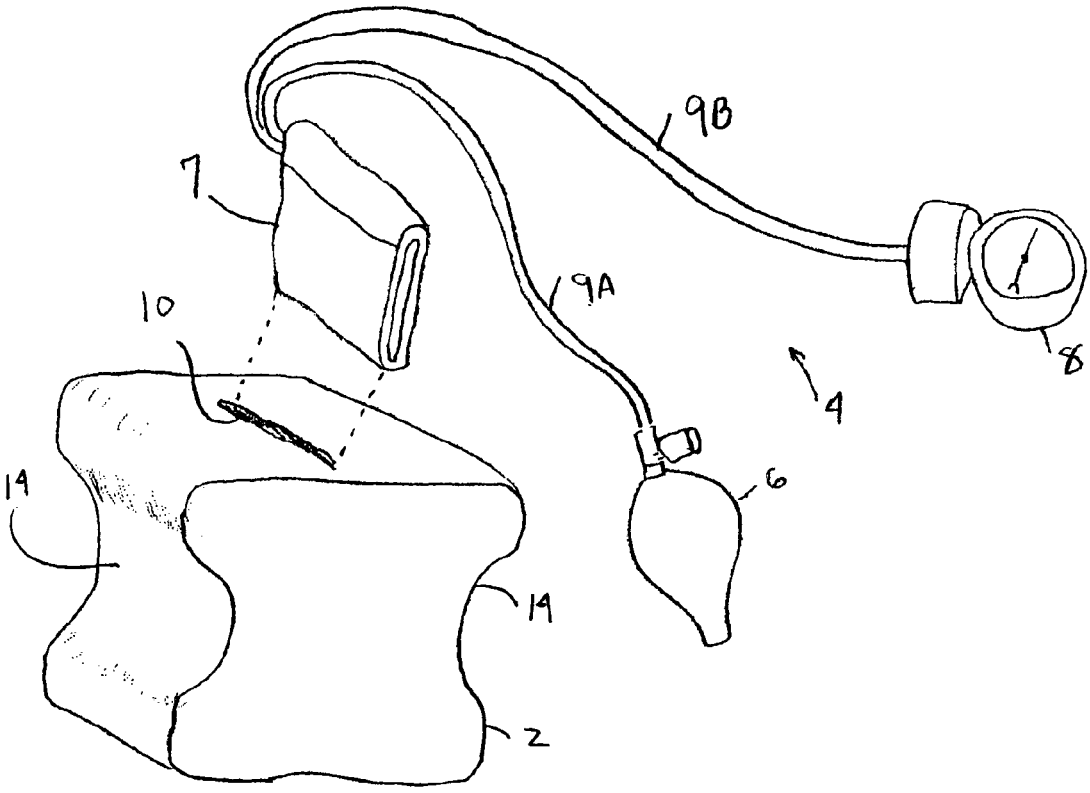
FIG. 2 is an exploded side perspective drawing of the therapy cushion 2 and sphygmomanometer 4 of FIG. 1.

FIG. 2 is an exploded side perspective drawing of the therapy cushion 2 and sphygmomanometer 4 of FIG. 1. The sphygmomanometer 4 is a conventional sphygmomanometer with pressure bulb 6 having suitable valves associated therewith, and an elongate cuff 7 usually having velcro attachments for fastening to an arm or leg and a pressure bag or bladder contained therein. A first air hose 9A connects the bulb 6 with the bladder 7, and a second air hose 9B connects the bladder 7 with a suitable pressure indicating meter 8. The meter 8 may include an analog meter (e.g. mercury manometer or aneroid dial) or digital read out. Such sphygmomanometers 4 are very accurate and comparatively inexpensive pneumatic monitoring devices, and yet they are solely used for measurement of arterial blood pressure. Prestige Medical® manufactures a suitable certified product line.

The preferred embodiment of the therapy cushion 2 has a contoured hourglass shape with side recesses 14 that allow it to be placed comfortably between the legs. A central pocket 10 at the top of cushion 2 allows insertion of the cuff 7 as will be described. The therapy cushion 2 may be formed of blown foam or other suitable material, and is preferably covered with a fabric or vinyl shell for aesthetics, leaving a slotted or zippered opening for passage of the air hoses 9A & 9B. Other shapes (other than hourglass) are better suited for a variety of other exercises as will be described.

Figure 3:
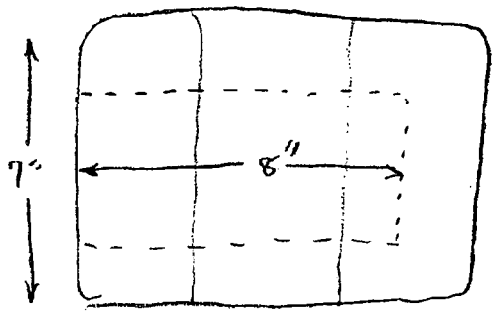
FIG. 3 is a top perspective drawing of the therapy cushion 2 of FIGS. 1 and 2.
Figure 4:
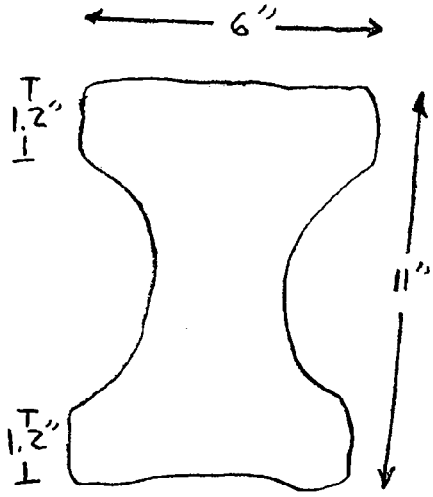
FIG. 4 is a side perspective drawing of the therapy cushion 2 of FIGS. 1–3.

FIGS. 3 and 4 are, respectively, top and side perspective drawings of the therapy cushion 2 of FIGS. 1 and 2. The contoured hourglass cross-section defines opposing recesses 14 dimensioned to fit, for example, the curve of the legs when placed there between. This external hourglass configuration permits a variety of compressive rehabilitation exercises for the hips, knees, arms and other joints. The therapy cushion 2 also has a particular internal configuration, namely a pocket 10 of dimensions shown in FIG. 3, that permits slidable insertion of the entire cuff 7 when in a folded configuration.

Figure 5:
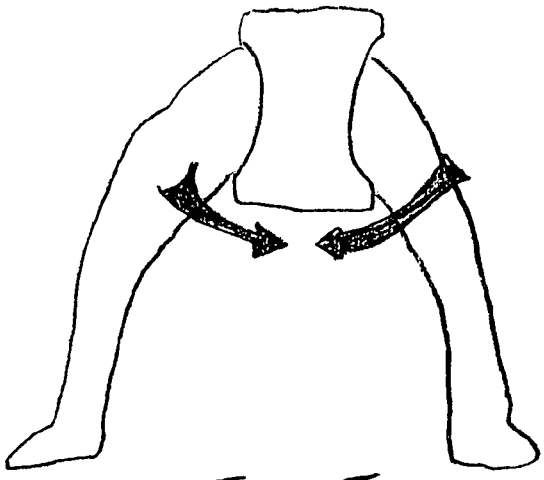
FIGS. 5–7 show the three most common exercises that may be administered with the therapy cushion 2/sphygmomanometer 4 combination of FIGS. 1 and 2.
Figure 6:
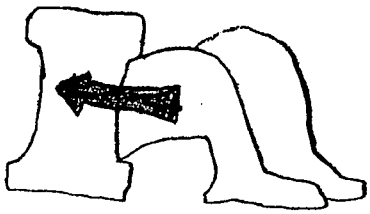
Figure 7:
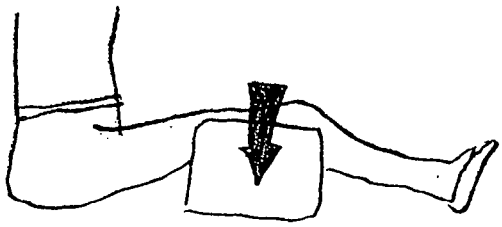

FIGS. 5–7 show the three most common exercises that may be administered with the therapy cushion 2/sphygmomanometers 4 of the present invention.

In FIG. 5, the therapy cushion 2 is placed between the legs above the knees and both knees are repetitively pressed inward to exercise the thighs.

In FIG. 6 the therapy cushion 2 is placed between the outside of one leg above the knee and against the wall, and is repetitively pressed against the wall to exercise the hip.

In FIG. 7, the therapy cushion 2 is placed beneath one leg and is repetitively pressed downward to exercise the calf. Many other possible exercises are possible, and these may be categorized as follows:

1. Shoulder Exercises

A. A shoulder strengthening exercise/external rotation with the therapy cushion 2. The patient slightly abducts arm about 30 degrees and presses back of hand into therapy cushion 2. The patient then holds the position for a prescribed period of time, releases, then repeats for the required number of repetitions.

B. A shoulder strengthening exercise/internal rotation with the therapy cushion 2. The patient inflates the cuff 7 inside the cushion 2 to the desired baseline pressure, then, using an edge of a wall, presses a palm of a hand into the inflated cushion 2 thereby increasing the pressure readout on the meter 8. The patient holds the position for a prescribed period of time, releases, and repeats as prescribed.

C. A shoulder strengthening exercise/shoulder flexion with the therapy cushion 2. The patient inflates the cuff 7 inside the cushion 2 to the desired baseline pressure, then, using a wall or doorway for resistance, presses the fist of the involved hand into the cushion 2 thereby increasing the pressure readout on the meter 8. The patient holds the position for a prescribed period of time, releases, and repeats as prescribed.

D. A shoulder strengthening exercise/shoulder extension with the therapy cushion 2. The patient inflates the cuff 7 inside the cushion 2 to the desired baseline pressure, then, using a wall or doorway for resistance, places the cushion above the elbow and back of the involved arm, then gently presses the back of the arm into therapy cushion 2 thereby increasing the pressure readout on the meter 8. The patient holds the position for a prescribed period of time, releases, and repeats as prescribed.

E. A shoulder strengthening exercise/shoulder abduction with the therapy cushion 2. The patient places the therapy cushion 2 under involved arm, then inflates the cuff 7 to the desired baseline pressure and begins to gently apply pressure with inside of arm into body, thereby increasing the pressure readout on the meter 8. The patient holds the position for a prescribed period of time, releases, and repeats as prescribed.

F. A shoulder strengthening exercise/shoulder abduction with the therapy cushion 2. The patient positions the therapy cushion 2 on the outside of the forearm, or the elbow, and against a wall or door, then inflates cuff 7 to the desired baseline pressure and gently moves the elbow away from the body and into the inflated cushion 2. The patient holds the position for a prescribed period of time, releases, and repeats as prescribed.

G. A shoulder strengthening exercise/shoulder adduction with the therapy cushion 2. The patient positions the therapy cushion 2 on the inside of the forearm/elbow between both arms or against a door frame, then inflates cuff 7 to the desired baseline pressure and gently presses both arms together or the one arm against the door frame. The patient holds the position for a prescribed period of time, releases, and repeats as prescribed.

H. A shoulder strengthening exercise/shoulder depression with the therapy cushion 2. The patient inflates the cuff 7 inside the cushion 2 to the desired baseline pressure, then, using a tabletop for resistance, shrugs the involved shoulder downward to press the fist of that hand into the center of the cushion 2 to increase the pressure readout on the meter 8. The patient holds the position for a prescribed period of time, releases, and repeats as prescribed.

2. Hip and Knee Exercises

A. A hip and knee strengthening exercise/hip flexion with the therapy cushion 2. The patient places the cushion 2 on top of the thigh above the knee and against a wall, inflates the cuff 7 inside the cushion 2 to the desired baseline pressure, then, begins to gently apply force against the wall with the involved knee. The patient holds the position for a prescribed period of time, releases, and repeats as prescribed.

B. A hip and knee strengthening exercise/hip abduction with the therapy cushion 2. The patient places the cushion 2 on the outside of the involved thigh above the knee and against a wall or door, inflates the cuff 7 inside the cushion 2 to the desired baseline pressure, then, begins to gently apply force against the wall with the involved leg, thereby increasing the pressure readout on the meter 8 to the desired level. The patient holds the position for a prescribed period of time, releases, and repeats as prescribed. Alternatively, the patient can strap cushion 2 on outside of thigh around both legs and gently apply pressure by separating legs.

C. A hip and knee strengthening exercise/terminal knee extension in a seated position with the therapy cushion 2. The patient places the cushion 2 under the involved knee above the thigh, inflates the cuff 7 inside the cushion 2 to the desired baseline pressure, then begins to gently apply pressure downward into the cushion toward the ground. The patient holds the position for a prescribed period of time, releases, and repeats as prescribed.

D. A hip and knee strengthening exercise/hip adduction in a seated position with the therapy cushion 2. Patient places the cushion 2 above the knees between the legs, inflates the cuff 7 inside the cushion 2 to the desired baseline pressure, then begins to gently apply pressure to the cushion 2 by pressing the thighs together, thereby increasing the pressure readout on the meter 8. The patient holds the position for a prescribed period of time, releases, and repeats as prescribed.

3. Ankle/Foot Exercises

A. An ankle/foot exercise/plantar flexion with the therapy cushion 2 in a seated position. The patient places the cushion 2 against a wall and places the involved foot in the center of the cushion 2, then begins to gently apply force with the ball and toes of the foot into the cushion 2, thereby increasing the pressure readout on the meter 8. The patient holds the position for a prescribed period of time, releases, and repeats as prescribed pressure.

B. An ankle/foot exercise/ankle eversion with the therapy cushion 2 in a seated position. The patient places the cushion 2 against a wall and places the involved foot in the center of the cushion 2, then begins to gently apply force with the outside portion of involved foot into the cushion 2, thereby increasing the pressure readout on the meter 8. The patient holds the position for a prescribed period of time, releases, and repeats as prescribed.

C. An ankle/foot exercise/dorsi flexion with the therapy cushion 2 in a seated position. The patient places the cushion 2 between the feet and ankles, then begins to gently apply pressure by forcing the feet together.

D. An ankle/foot inversion with the therapy cushion 2 in a seated position. The patient inflates the cushion 2 to the desired start point, then presses the inner boarders of the feet into the cushion 2.

E. An ankle/foot exercise/heel depression with the therapy cushion 2 in a seated position. The patient places the cushion 2 on the floor and, with the knee bent at an angle of 90–120 degrees, places the involved heel in the center of the cushion 2, then begins to gently apply downward force into the cushion 2, thereby increasing the pressure readout on the meter 8. The patient holds the position for a prescribed period of time, releases, and repeats as prescribed.

4. Arm and Neck Exercises

Further exercises similar to those described above include those for a patient's upper limbs and neck. Two examples are:

A. A neck exercise/upper cervical extension with the therapy cushion 2 while lying on a flat surface. The patient places the cushion 2 on a flat surface and, while lying flat on that surface with the spine in a neutral position, places the back of the head in the center of the cushion 2. With the chin tucked and the head slightly extended, the patient then begins to gently apply downward force into the cushion 2, thereby increasing the pressure readout on the meter 8. The patient repeats the process as prescribed.

B. A neck exercise/neck extension with the therapy cushion 2 while lying on a flat surface. The patient places the cushion 2 on a flat surface and, while lying flat on that surface with the spine in a neutral position, places the back of the head in the center of the cushion 2. The patient then tilts the head back to gently apply downward force into the cushion 2, thereby increasing the pressure readout on the meter 8. The patient repeats the process as prescribed.

In all of the foregoing instances, the therapist administers (or the patient 150 self-administers) the exercise by inflating the cuff 7 via the bulb 6 to a prescribed baseline pressure, as indicated on the meter 8, of approximately 100–150 mm Hg. The patient is then required to complete a repetitive set of exercises during which the therapy cushion 2 is compressed to raise the pressure by approximately 30–100 mm Hg, thereby increasing the pressure readout of the meter 8 from the baseline to the prescribed maximum for the exercise. The patient 150 m or therapist monitors progress by reading the meter 8 for appropriate self-monitoring of relevant exercises, and journaling the results. In all such cases, pressure on the cuff 7 can be increased, decreased or maintained depending upon the requirements of the exercise.

FIGS. 8–14 show a series of alternative embodiments of therapy cushions 20–80 according to the present invention.

Figure 8:
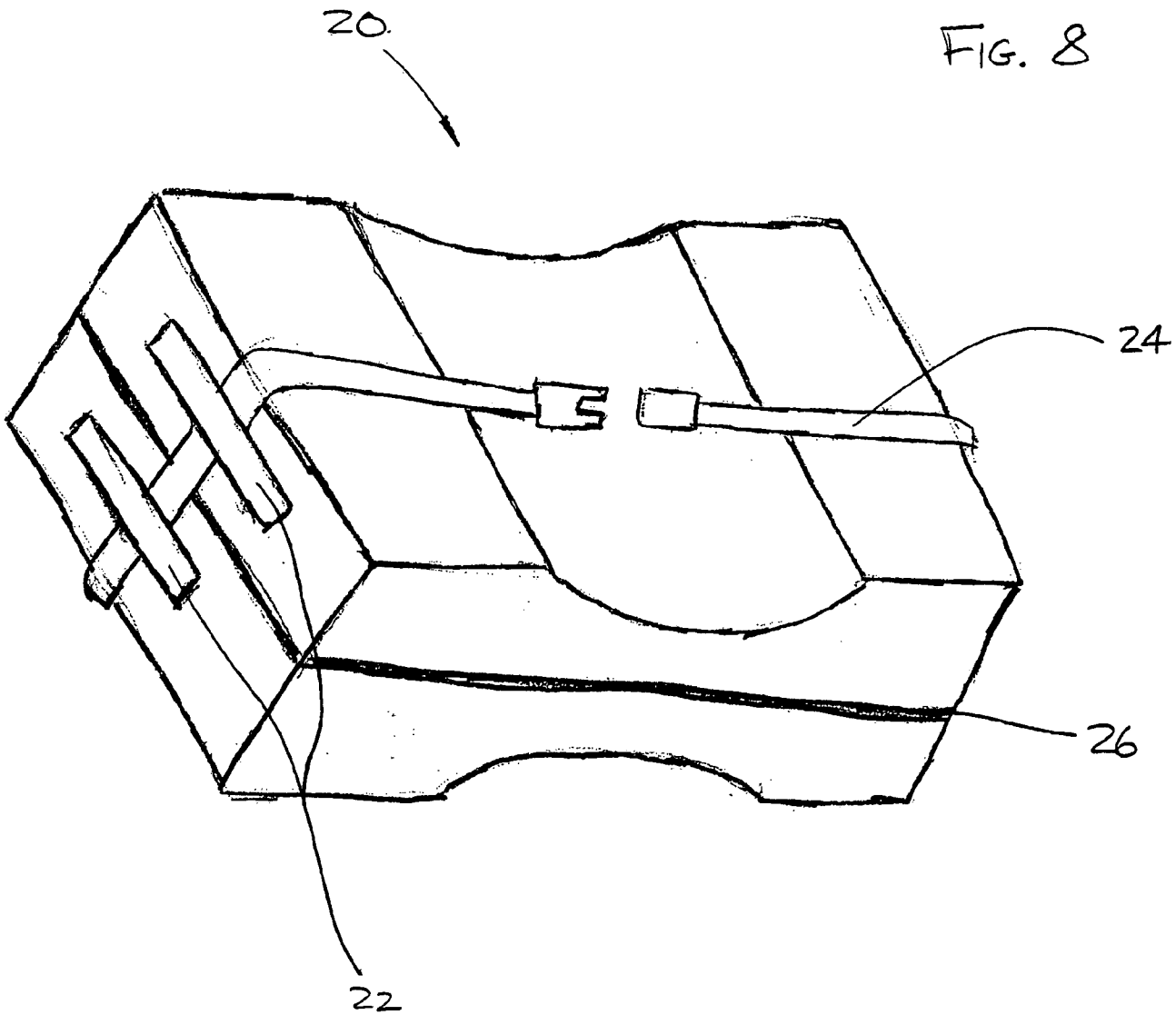
FIGS. 8–17 are perspective views showing a series of alternative embodiments for therapy cushions 20–110 according to the present invention.

The therapy cushion 20 of FIG. 8 possesses an overall shape that is substantially similar to that of the preferred embodiment of FIGS. 1–4. However, the cushion 20 is equipped with opposing bottom straps 22 sewn or otherwise secured to the therapy cushion 20 at both ends, and an elongate elastic strap 24 with distal fastening means such as buckles or clasps to secure the therapy cushion 20 to a chosen body part. The strap configuration secures the therapy cushion 20 to the body and makes it easier to use when compressing it against a wall or other surface. In addition, the straps 22, 24 facilitate combination exercises other than those described above. For example, the presence of the straps 22, 24 allows a patient to exercise two body parts simultaneously (e.g. a hip adduction/leg press in combination with a hip abduction/shoulder adduction. In this embodiment a zipper 26 encircles the cushion 20 thereby providing access to the interior (including central pocket 10), and also allowing the internal foam pads to be separated into two half-cushions that may be used individually.

Figure 9:
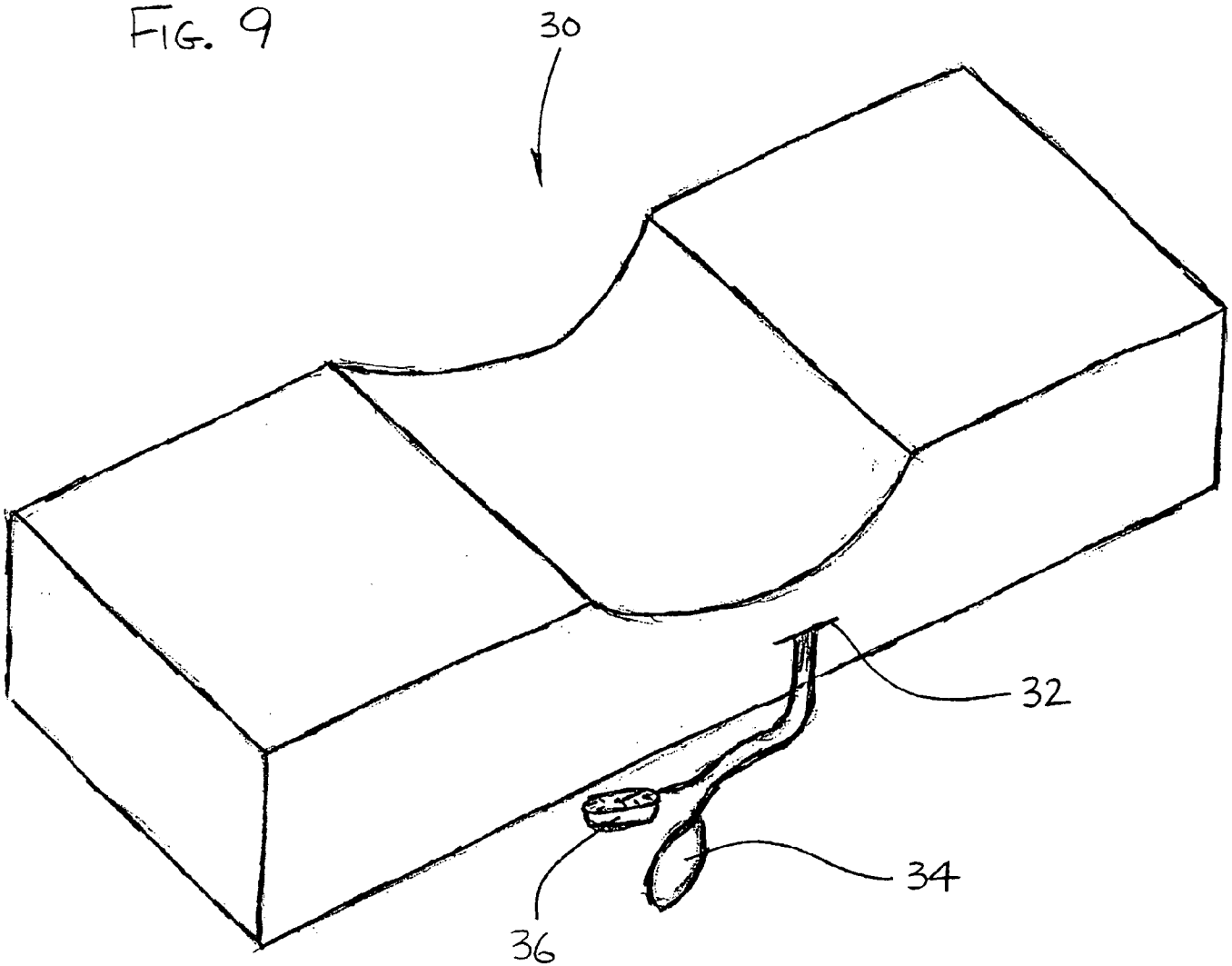

FIG. 9 shows a therapy cushion 30 in a half-hourglass shape, as would be used as a half-cushion described above with respect to FIG. 8. This alternative embodiment does include a central pocket 32 from which a cuff inflation bulb 34 and pressure meter 36 are shown protruding.

Figure 10:
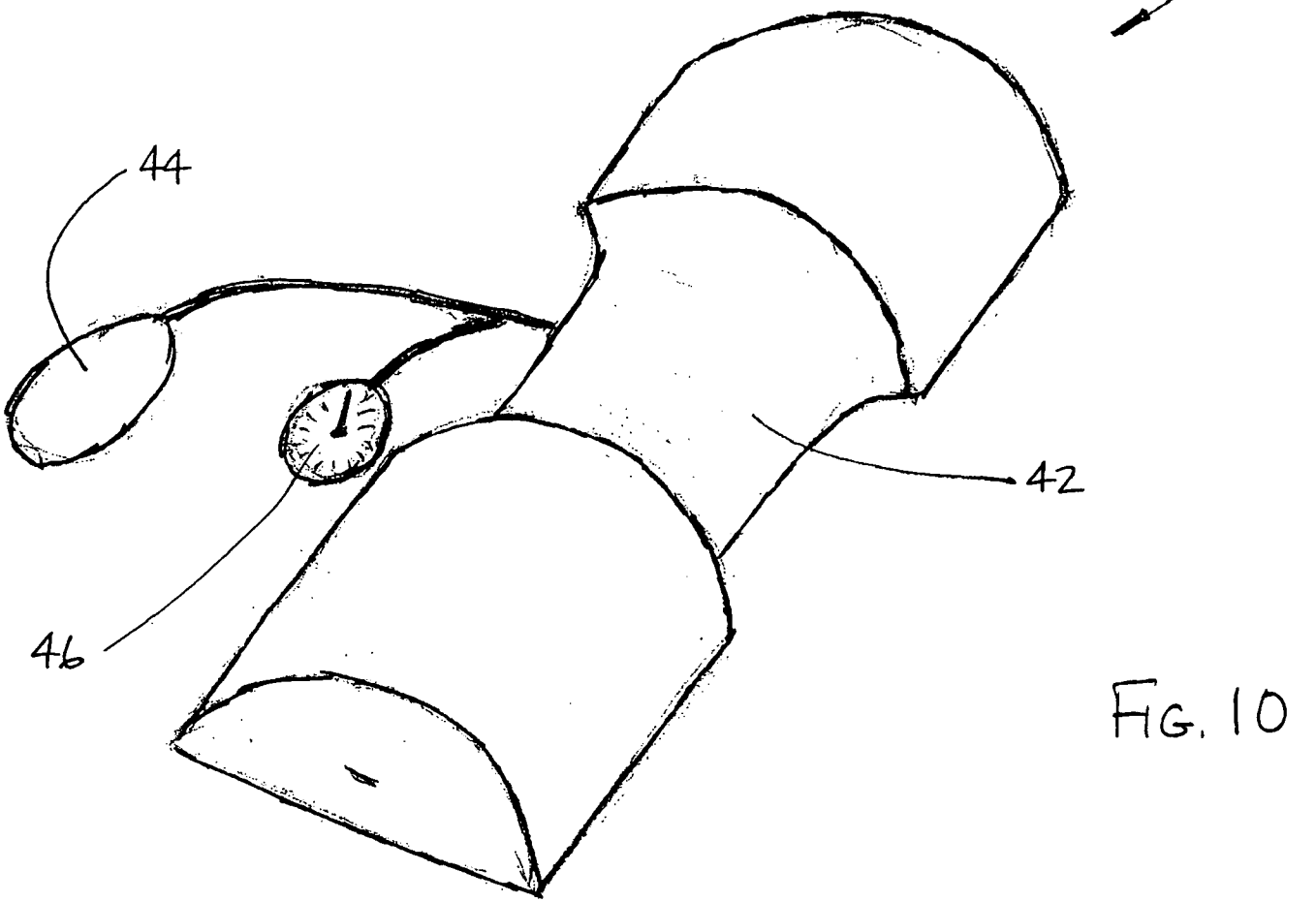

FIG. 10 shows a therapy cushion 40 with a half-round/half-flat external configuration. The central section 42 is formed with contoured recess into which a patient's extremities may be placed while exercising with the cushion 40. Once again, this alternative embodiment includes a central pocket from which a cuff inflation bulb 44 and pressure meter 46 are shown protruding.

Figure 11:
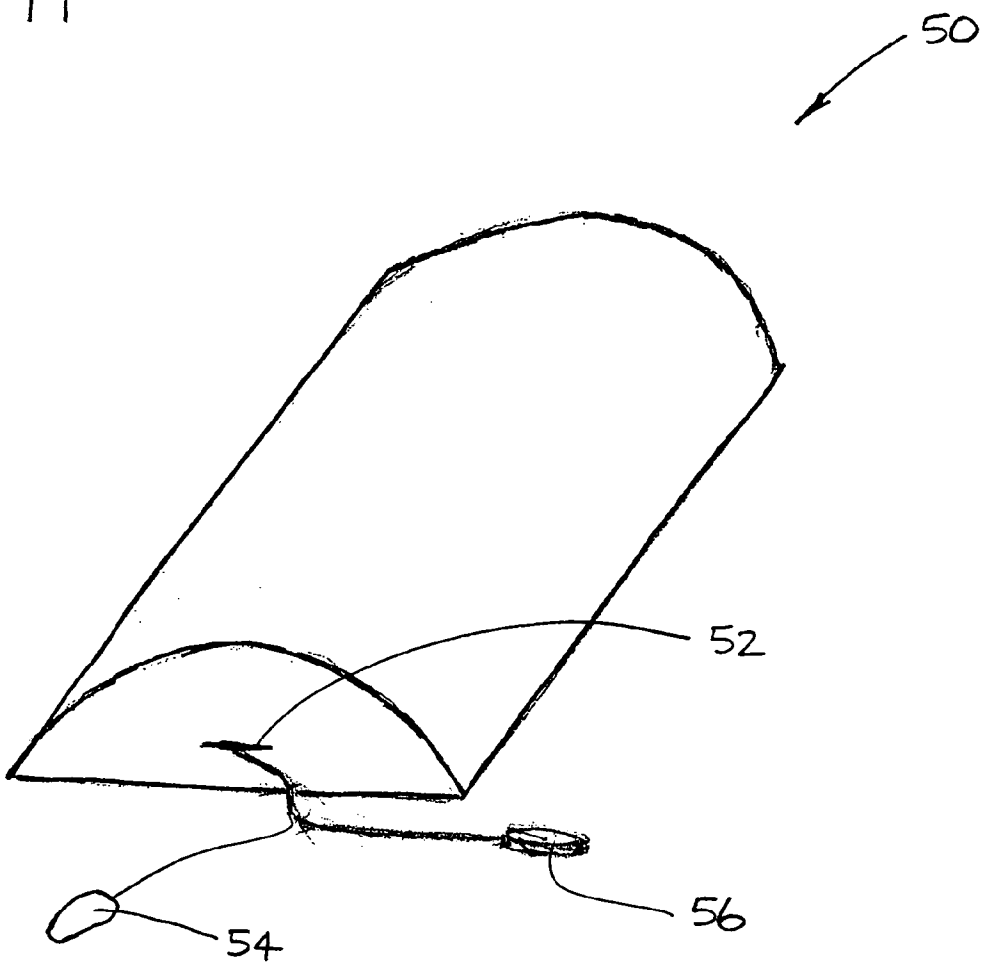

FIG. 11 shows another therapy cushion 50 with a half-cylindrical configuration. While the cushion 50 does not include the central, contoured recess of the embodiment of FIG. 10, it does, in a manner similar to the other embodiments, include a central pocket 52 from which a cuff inflation bulb 54 and pressure meter 56 are shown protruding.

Figure 12:
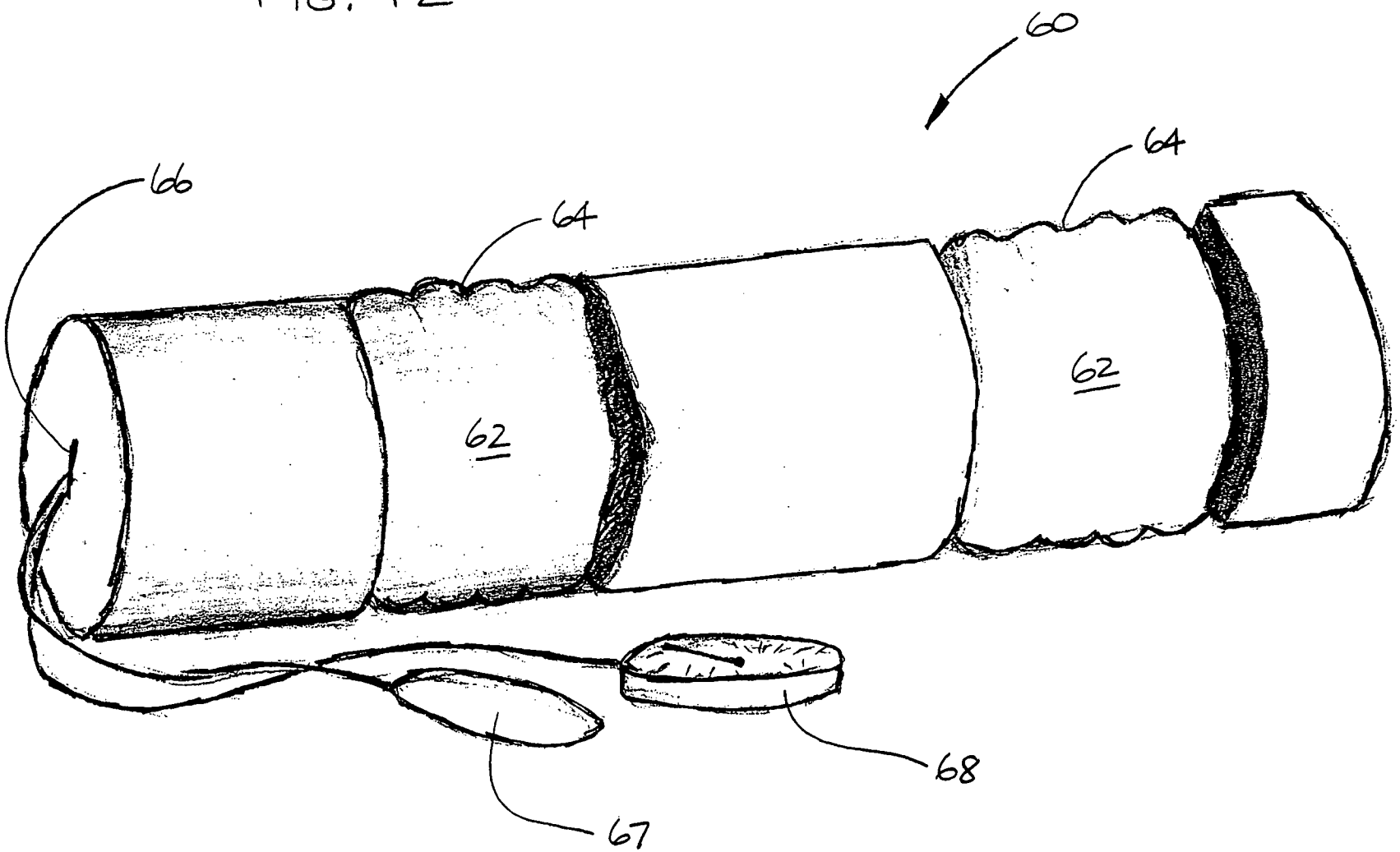

FIG. 12 shows a therapy cushion 60 with a substantially cylindrical configuration. The cushion 60 includes two sections 62 formed with indentations 64 simulating the spacing between the fingers of a human hand. This cushion 60 is, therefore, primarily intended for use in exercising/rehabilitating an individual's hands and forearms. Again, as with the other embodiments, the cushion 60 includes a central pocket 66 from which a cuff inflation bulb 67 and pressure meter 68 are shown protruding. Additional embodiments of the present invention include cylindrical and substantially cylindrical cushions without the aforementioned sections or indentations.

Figure 13:
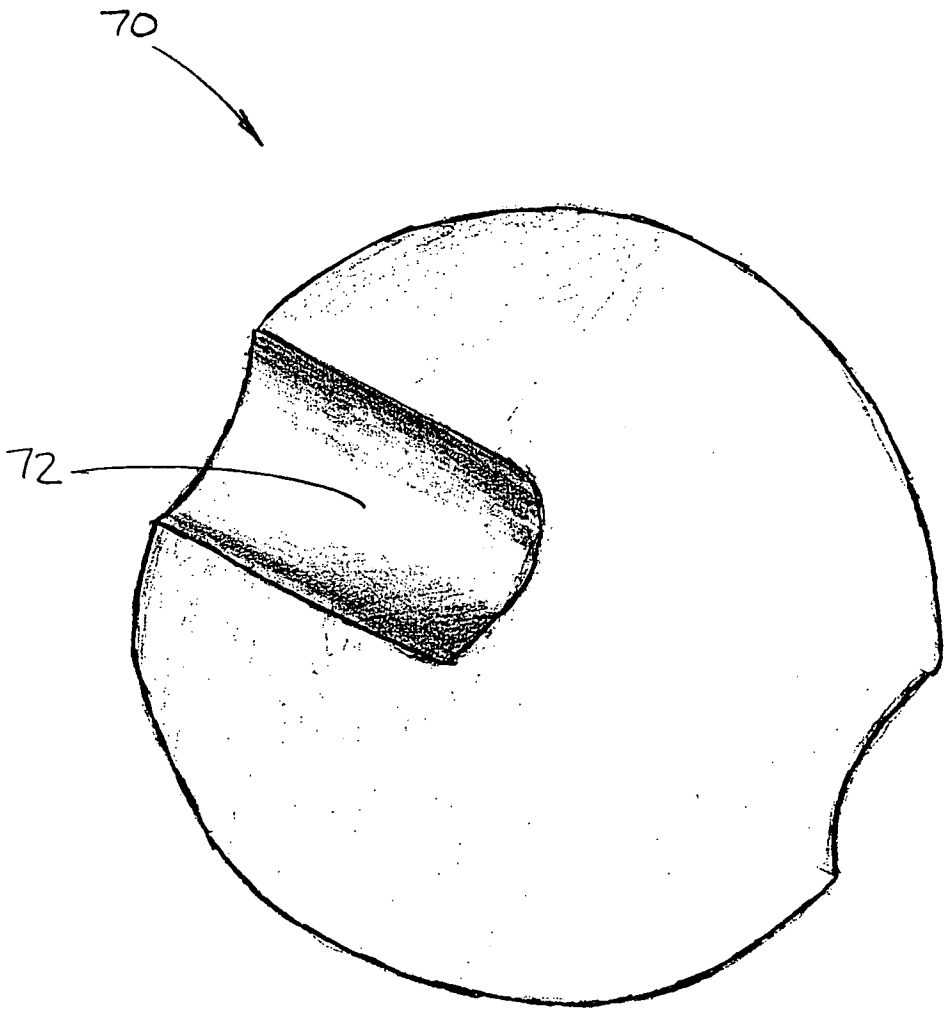
Figure 14:
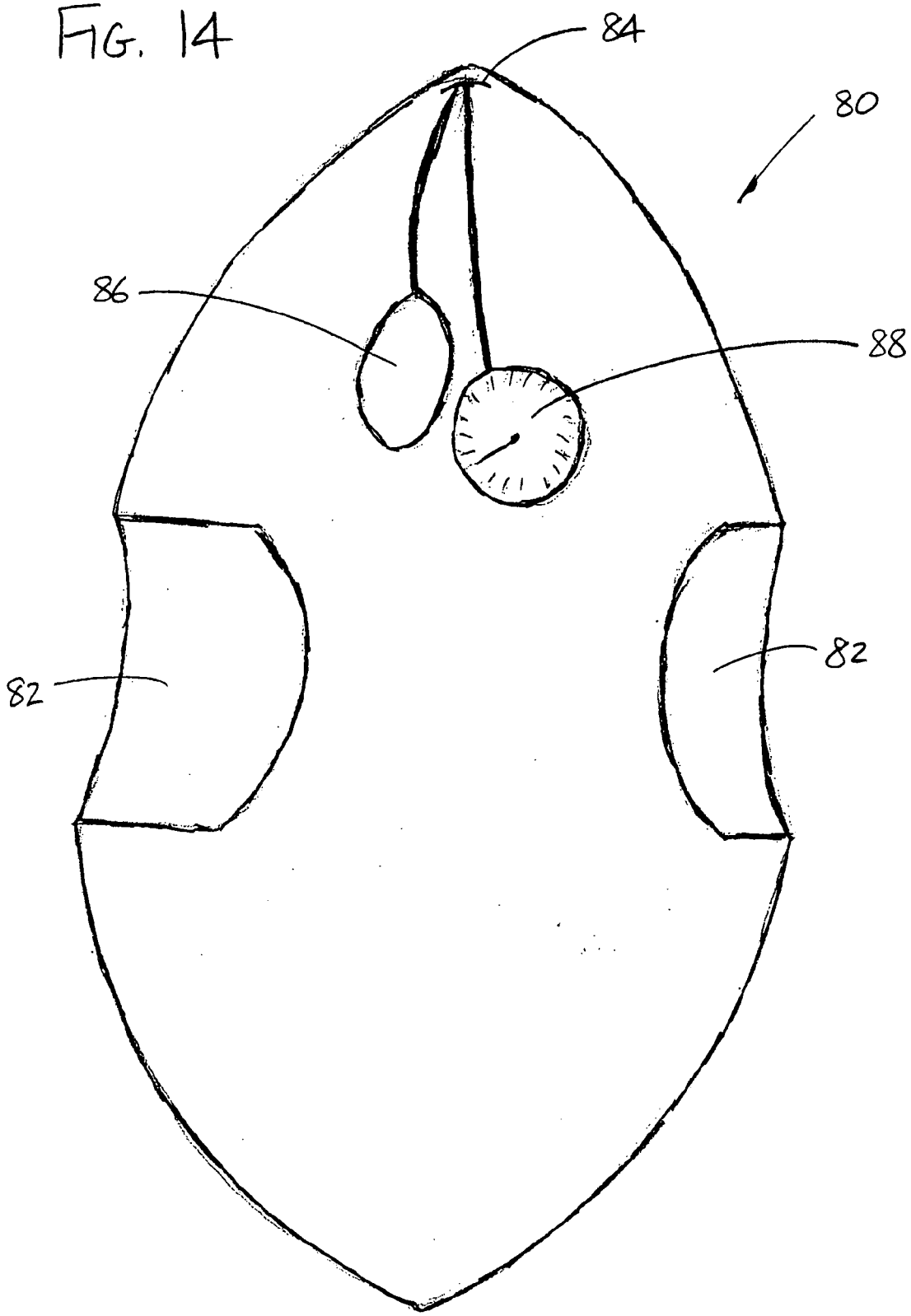

FIGS. 13 and 14 show, respectively, therapy cushions 70, 80 having spherical and football-like configurations. Both are formed with contoured recesses 72, 82 into which a patient's extremities may be placed while exercising with the cushion 70, 80. The cushion 80 of FIG. 14 includes a central pocket 84 from which a cuff inflation bulb 86 and pressure meter 88 are shown protruding. The cushion 70 of FIG. 13 also includes a central pocket (not shown in the Figure) into which a cuff may be inserted and from which a cuff inflation bulb and pressure meter may protrude. Additional embodiments of the present invention include spherical and football-like cushions without the aforementioned contoured recesses.

Figure 15:
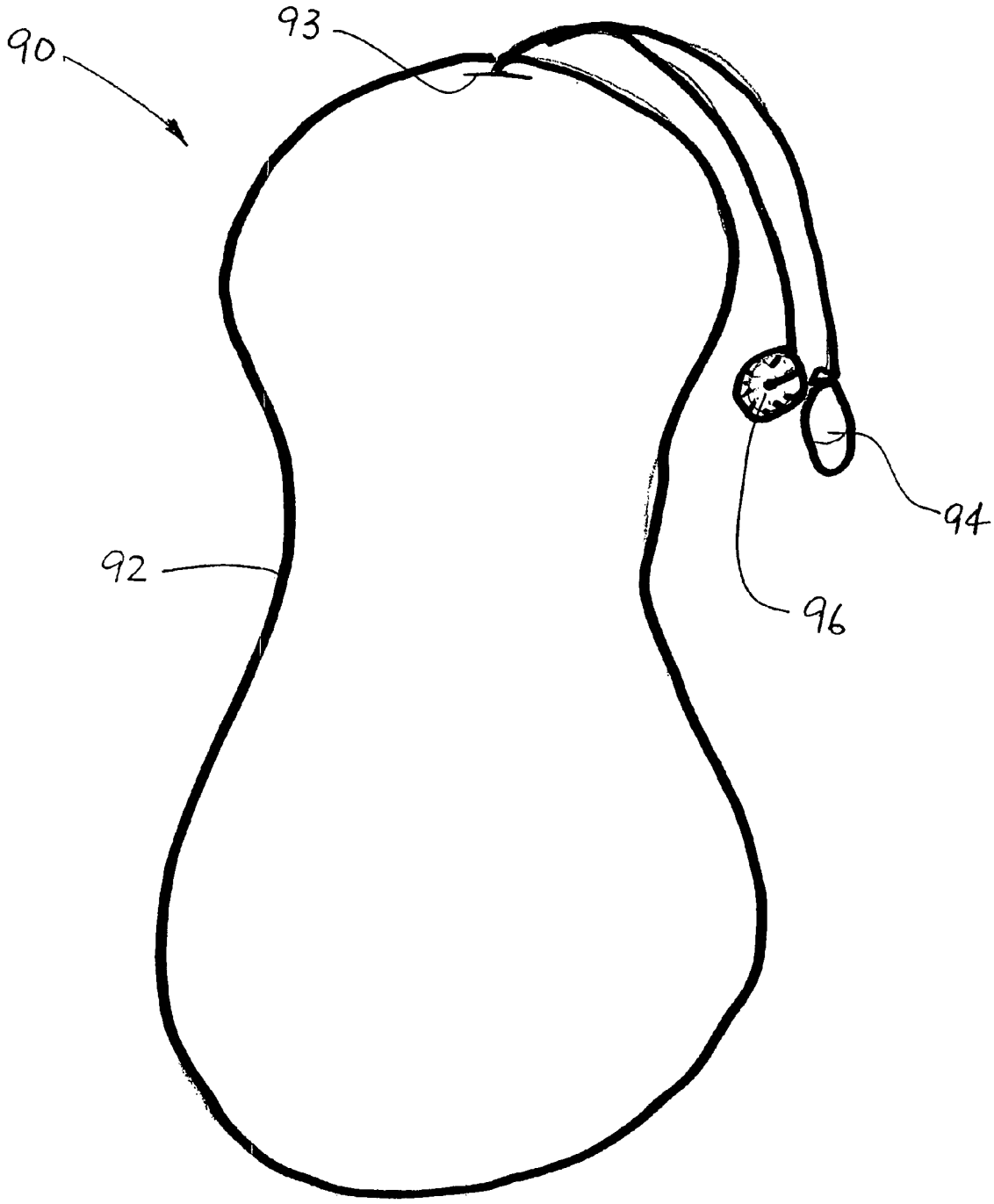

FIG. 15 shows another therapy cushion 90 with a peanut-shaped configuration. The cushion 90, according to the natural shape of a peanut, includes a central, contoured recess 92 into which a patient's extremities may be placed while exercising with the cushion 90. In a manner similar to the other embodiments, it also includes a central pocket 93 from which a cuff inflation bulb 94 and pressure meter 96 are shown protruding.

Figure 16:
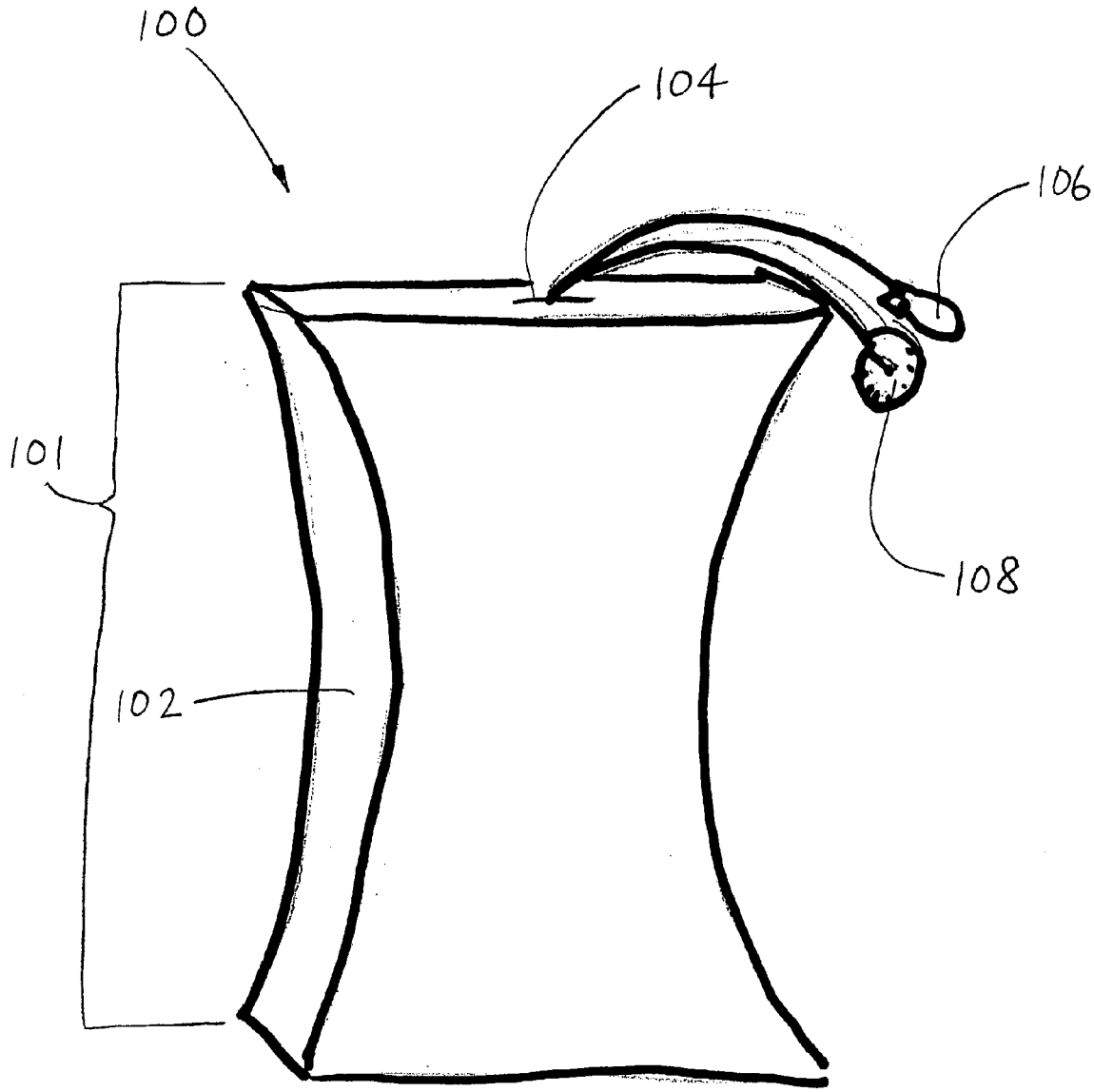
Figure 17:
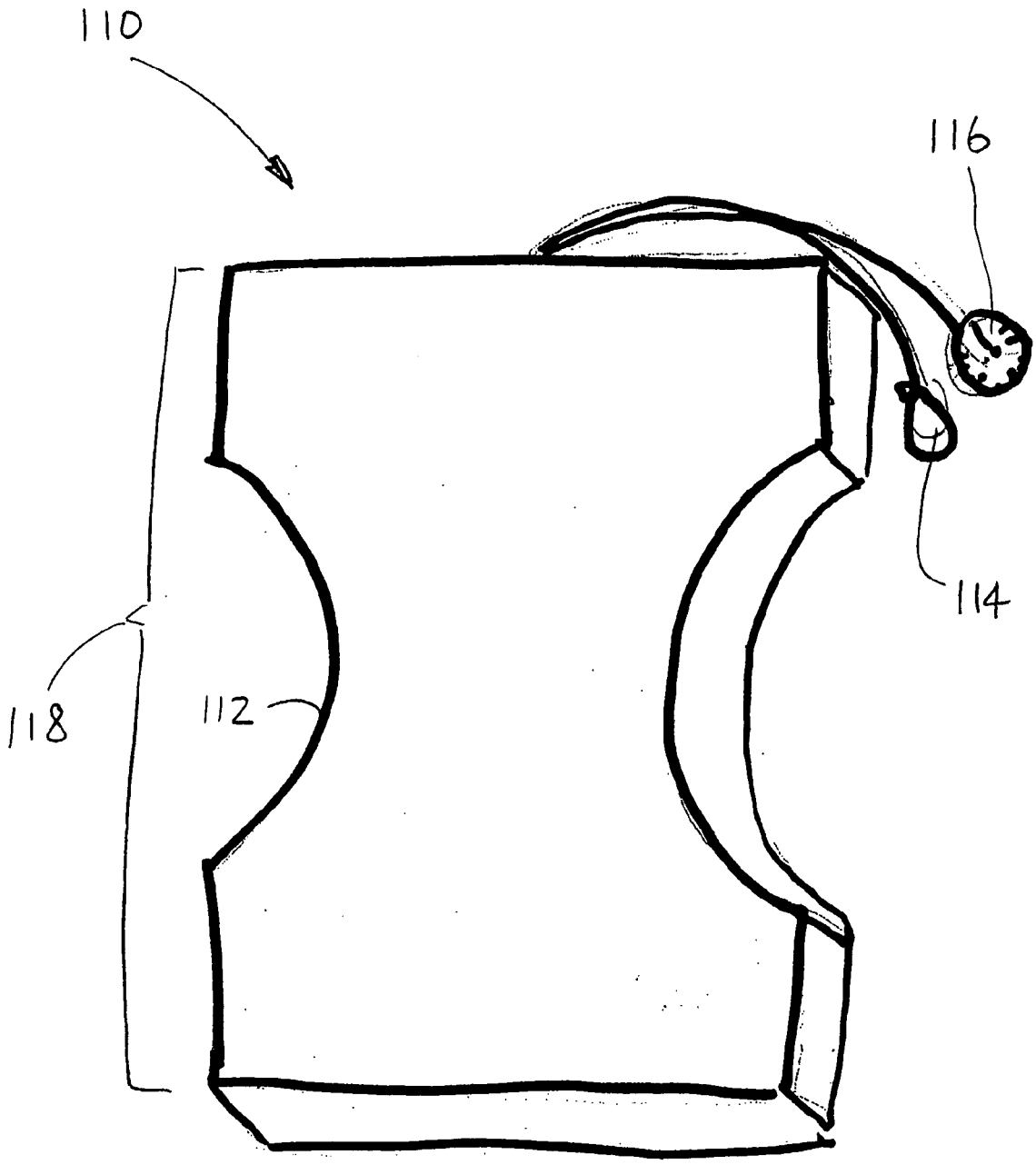
Figure 1:
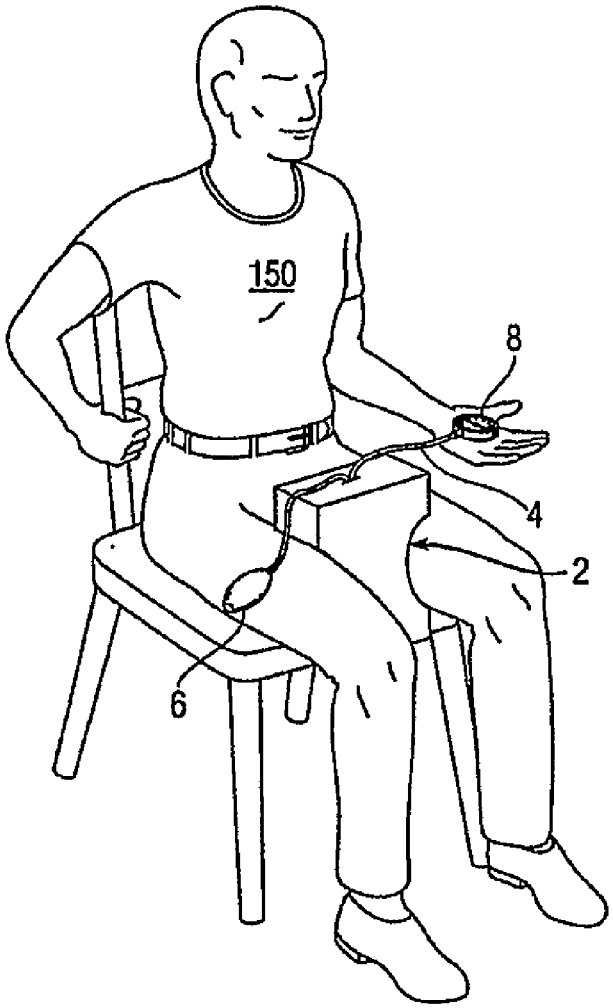
Figure 2:
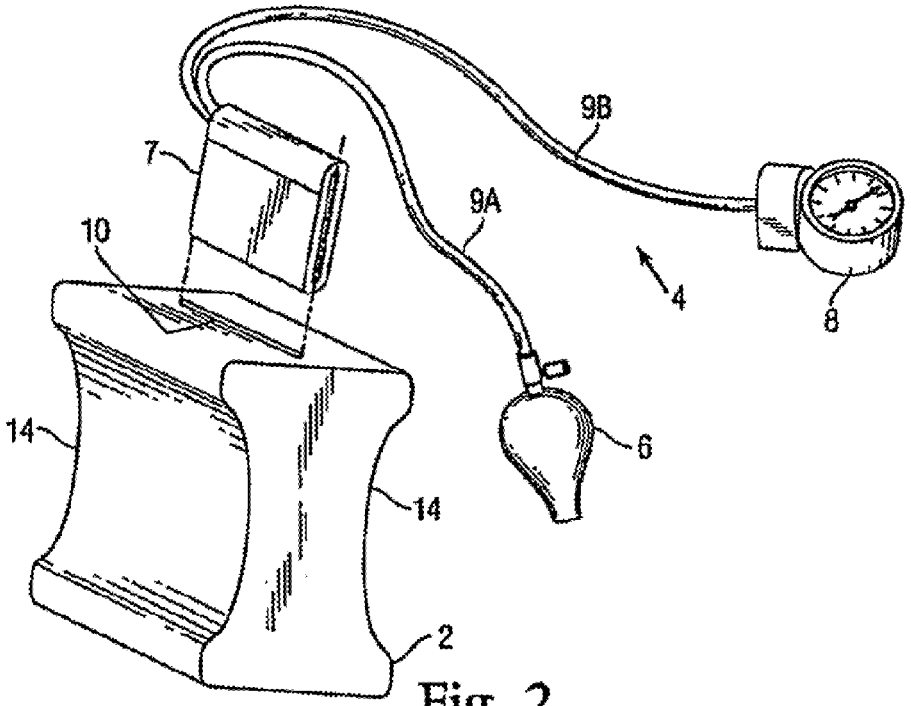
Figure 3:
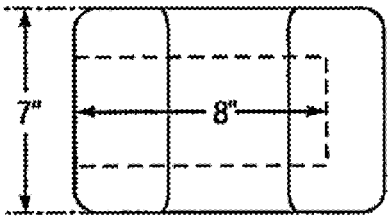
Figure 4:
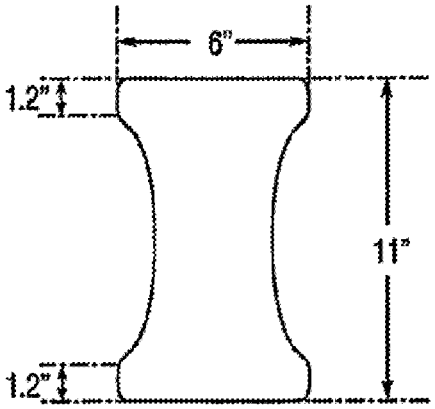
Figure 5:
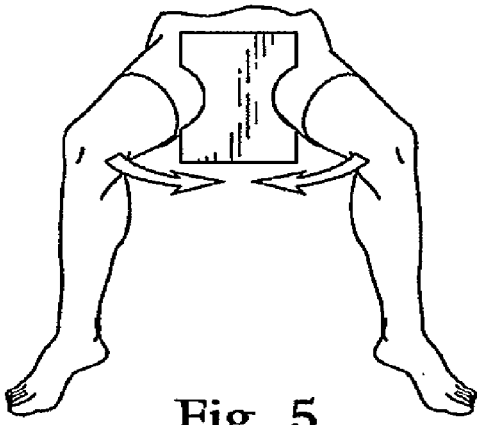
Figure 6:
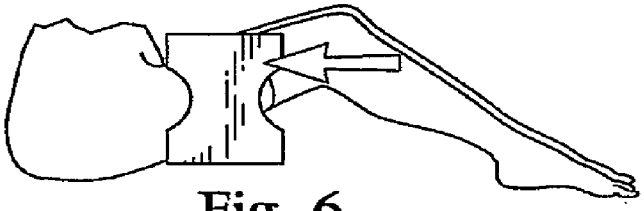
Figure 7:
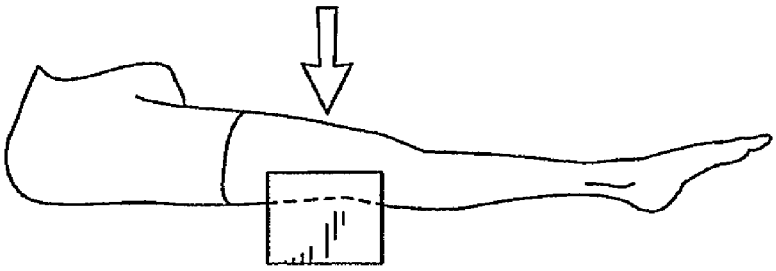
Figure 8:
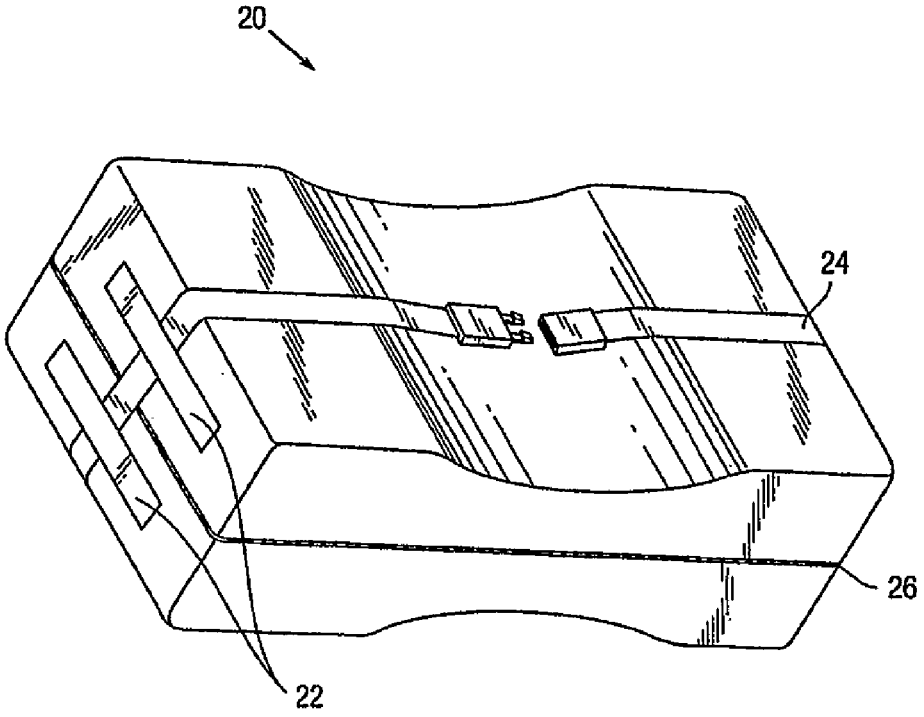
Figure 9:
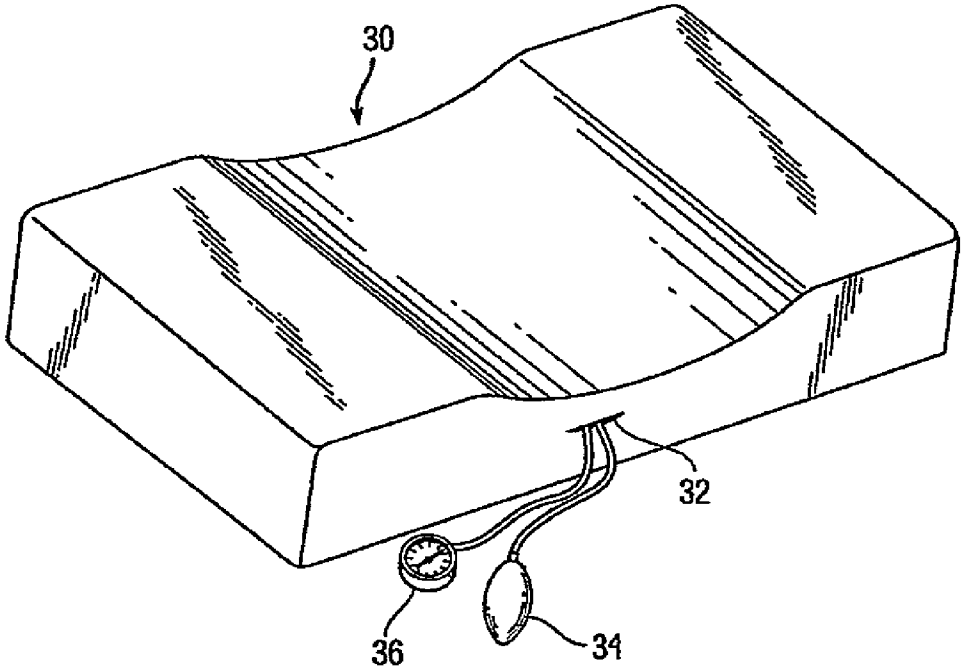
Figure 10:
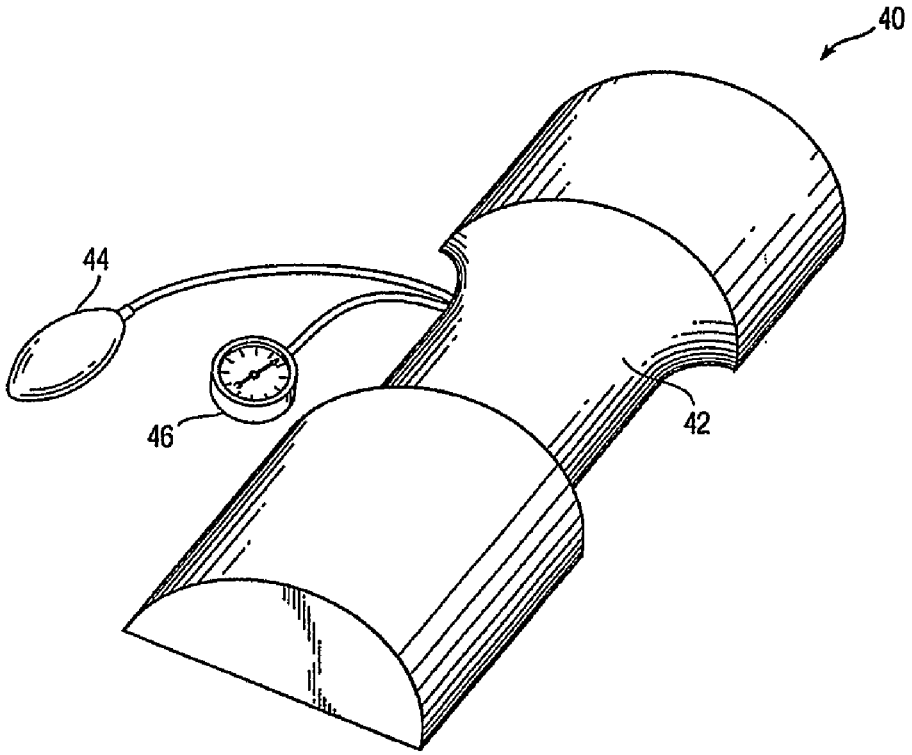
Figure 11:
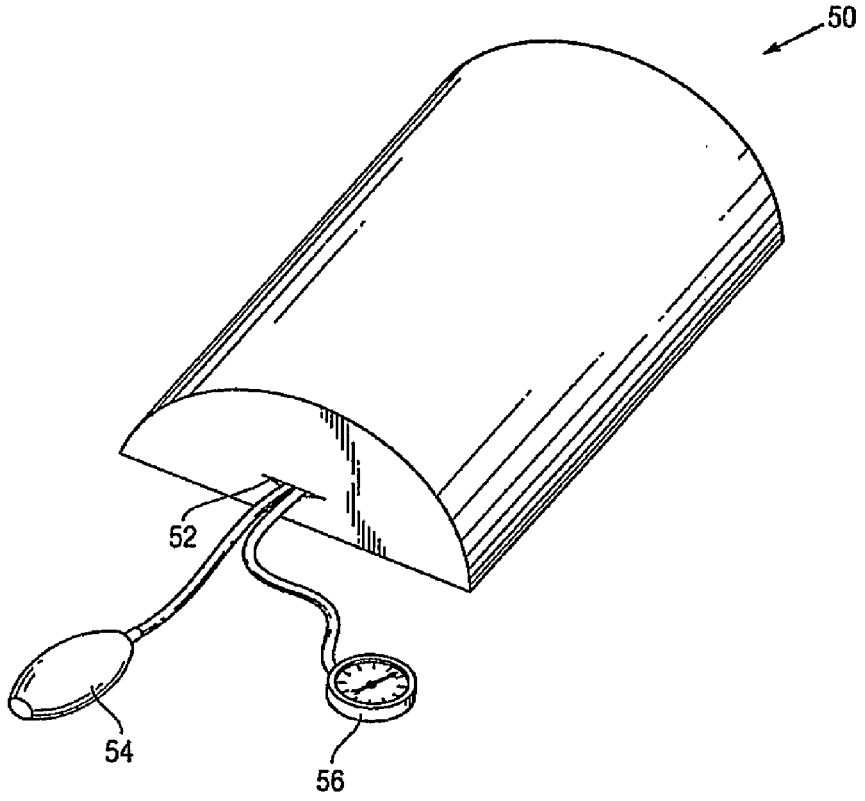
Figure 12:
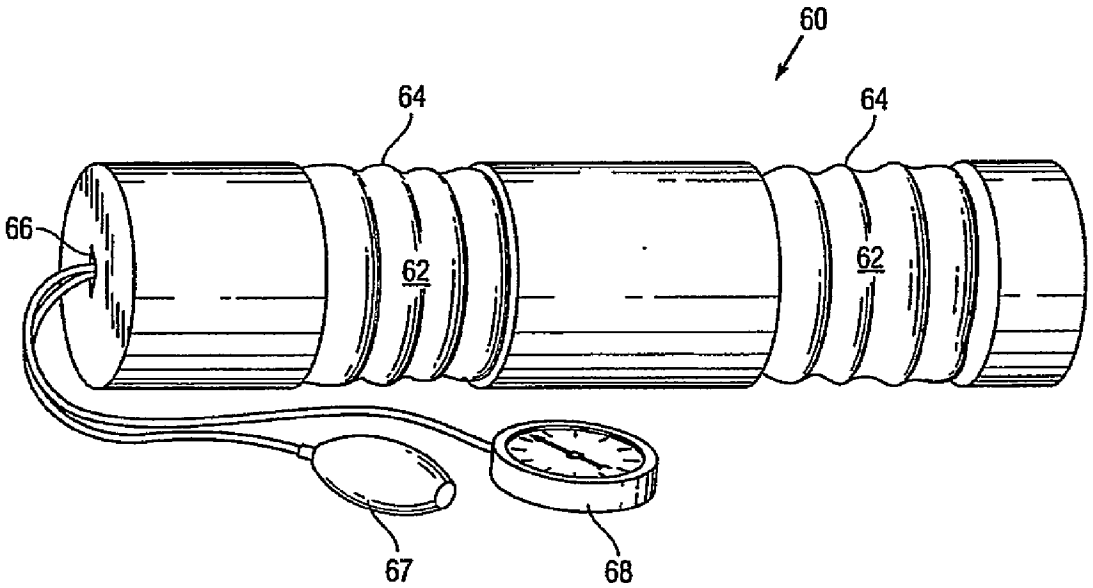
Figure 13:
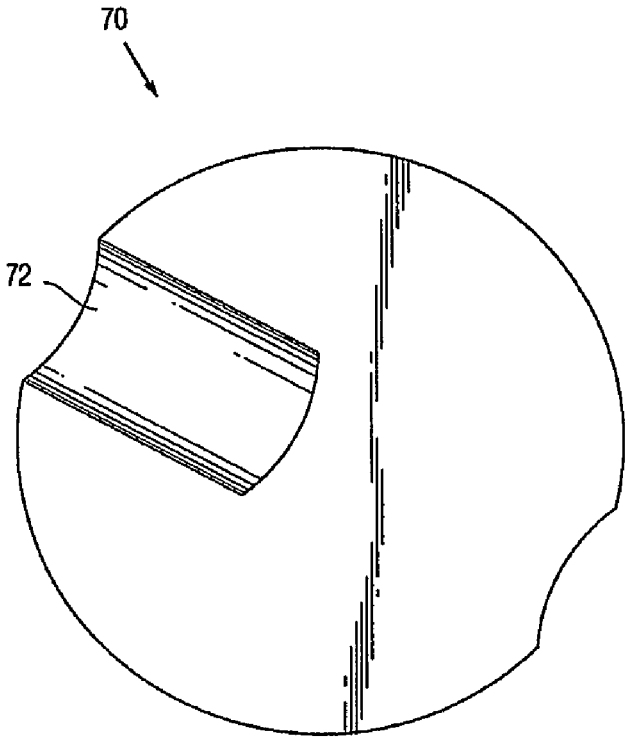
Figure 14:
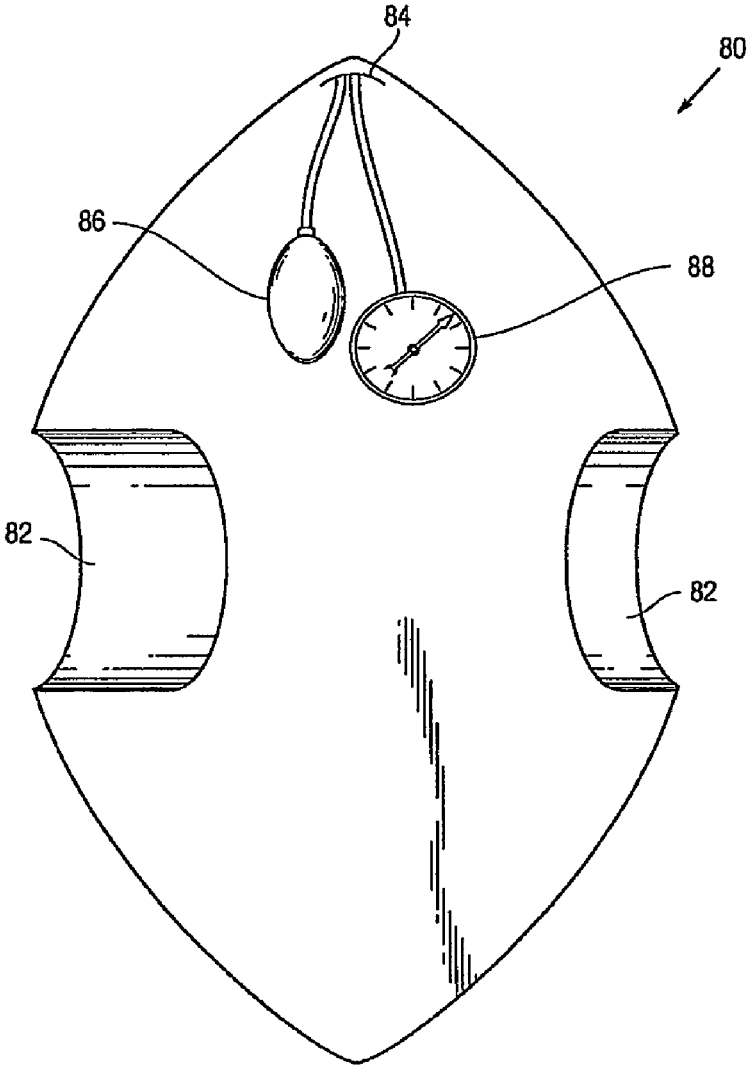
Figure 15:
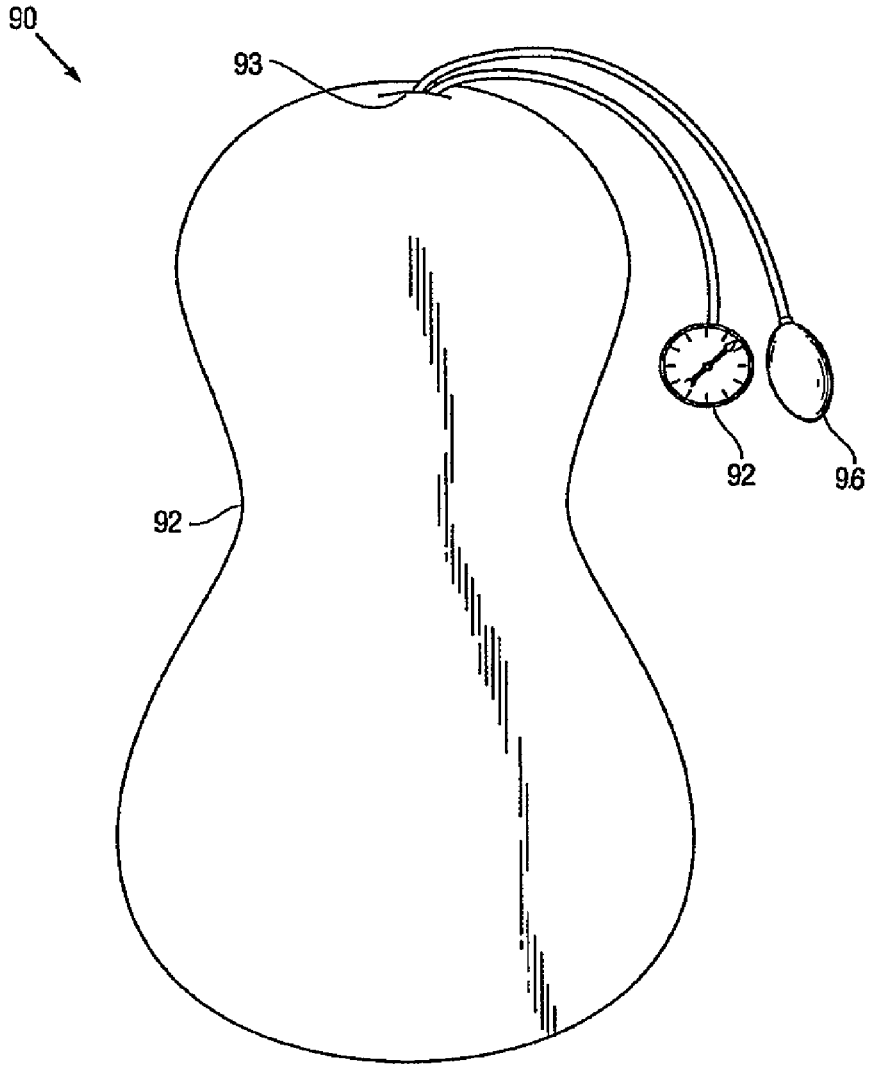
Figure 16:
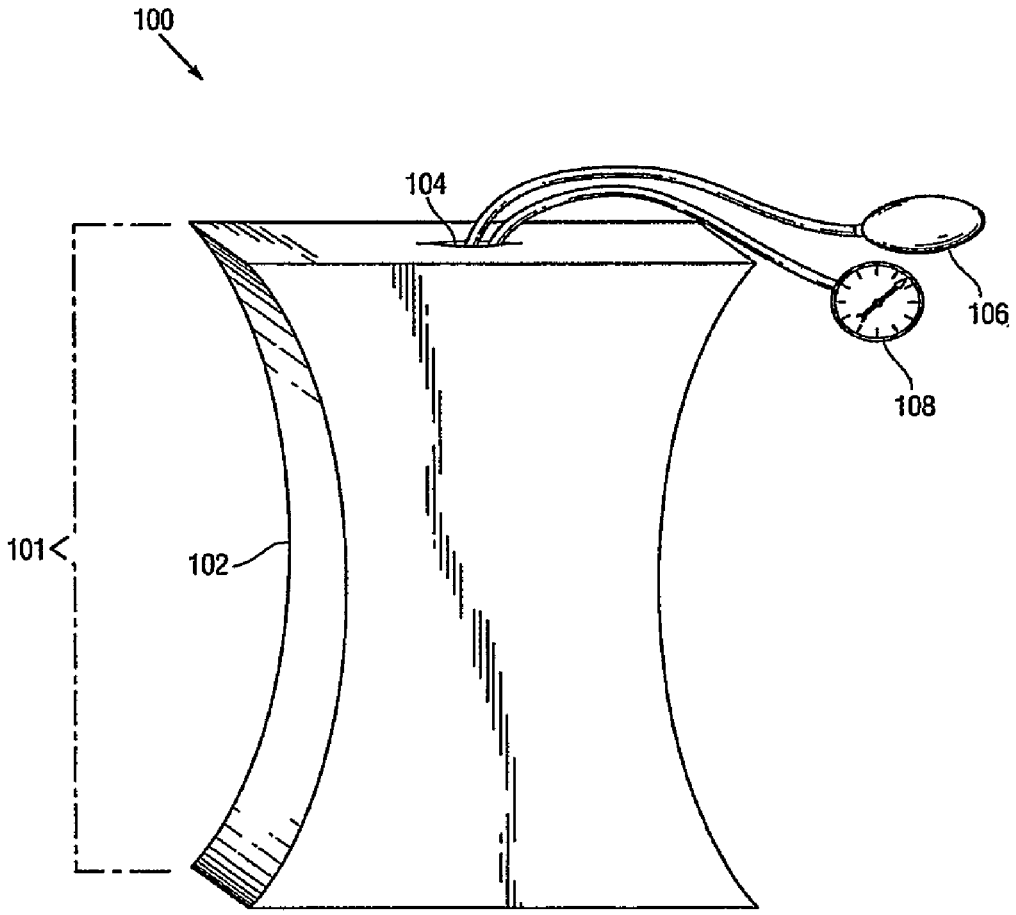
Figure 17:
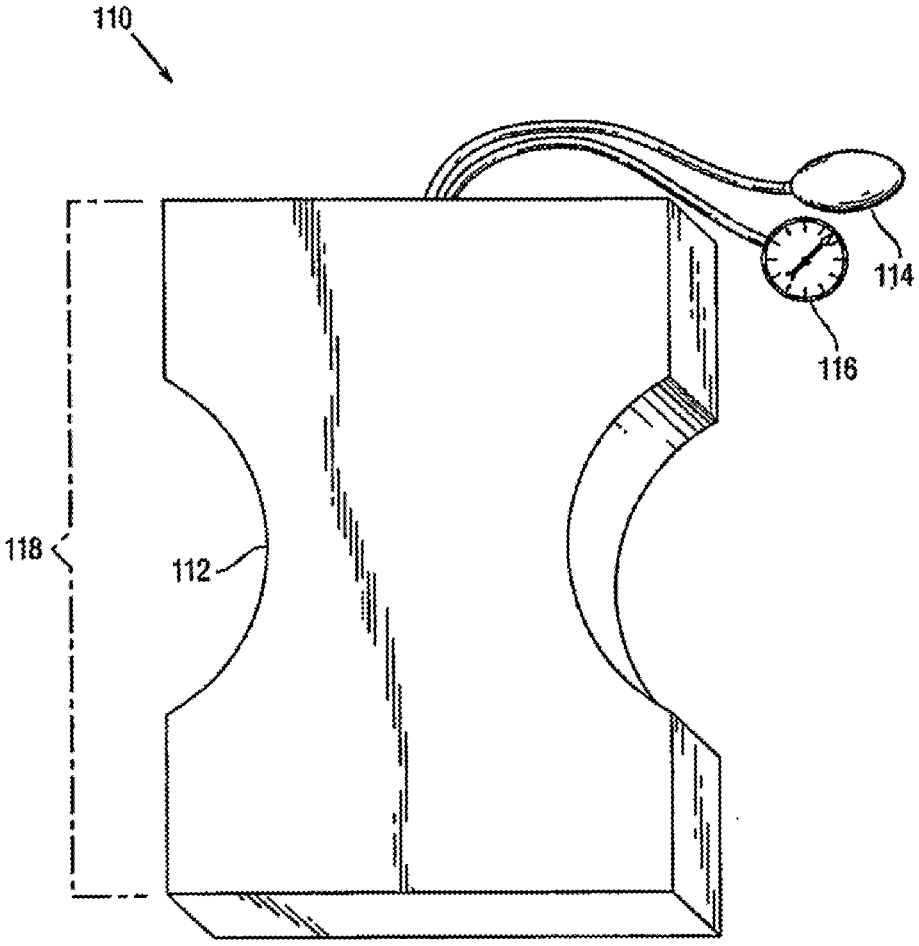

FIGS. 16 and 17 show, respectively, therapy cushions 100, 110 having substantially rectangular configurations. Both are formed with contoured recesses 102, 112 into which a patient's extremities may be placed while exercising with the cushion 100, 110. The cushion 110 of FIG. 17 includes recesses 112 formed along only a portion of the sides 118, whereas in the cushion 100 of FIG. 16, the contoured recesses 102 are formed along the entire length of the sides 101. The cushion 100 of FIG. 16 includes a central pocket 104 from which a cuff inflation bulb 106 and pressure meter 108 are shown protruding. The cushion 110 of FIG. 17 also includes a central pocket (not shown in the Figure) into which a cuff may be inserted and from which a cuff inflation bulb 114 and pressure meter 116 may protrude. Additional embodiments of the present invention include rectangular and substantially rectangular (e.g. square) configurations without the aforementioned contoured recesses.

It should be appreciated from the foregoing that the therapy cushion 2 improves the accuracy of calibrated monitoring of a wide variety of physiotherapy/rehabilitation exercises for the hips, knees, and other joints using a device that is small/compact and inexpensive.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. In combination with a conventional sphygmomanometer having a cuff, a meter, and a bulb connected by one or more airlines, a therapy cushion for the rehabilitation of hips, knees, or other joints comprising a resilient pad defined by a central pocket for insertion of the cuff of said sphygmomanometer, said cuff being insertable into the pocket of said therapy cushion, and said therapy cushion positioned adjacent a body part to be exercised;

whereby said cuff is inflated via said bulb to a prescribed baseline pressure readout on said meter, and said body part is exercised pursuant to a repetitive series of exercises that compress and decompress said therapy cushion, thereby causing said pressure readout to move between said baseline pressure and an achieved pressure.

2. The therapy cushion according to claim 1, wherein said resilient pad is fabricated of blown foam.

3. The therapy cushion according to claim 2, wherein said resilient pad is housed within a fabric shell.

4. The therapy cushion according to claim 1, wherein said resilient pad is formed with an hourglass cross-section with opposing recesses to fit two limbs of said patient when placed there between.

5. The therapy cushion according to claim 4, further comprising at least one end strap for attaching the therapy to attach facilitate use of said cushion in additional exercises wherein said patient may exercise two body parts simultaneously.

6. The therapy cushion according to claim 4, further comprising one or more elastic straps to facilitate use of said cushion in additional exercises wherein said patient may exercise two body parts simultaneously.

7. The therapy cushion according to claim 4, further comprising a zipper encircling said therapy cushion providing greater access to said central pocket or allowing said cushion to be separated into two half-cushions that may be used individually.

8. The therapy cushion according to claim 1, wherein said resilient pad is formed with a half-round/half-flat external configuration.

9. The therapy cushion according to claim 8, wherein a central section of said therapy cushion is formed with a contoured recess into which a patient's extremity may be placed while exercising.

10. The therapy cushion according to claim 1, wherein said resilient pad is formed with a substantially cylindrical configuration.

11. The therapy cushion according to claim 10, further comprising two sections formed with indentations conforming to the fingers of a human hand for use in exercising/rehabilitating said patient's hands and forearms.

12. The therapy cushion according to claim 1, wherein said resilient pad is formed with a spherical configuration.

13. The therapy cushion according to claim 12, wherein said therapy cushion is formed with opposing contoured recesses into which a patient's extremities may be placed while exercising.

14. The therapy cushion according to claim 1, wherein said resilient pad is formed with a football-like configuration.

15. The therapy cushion according to claim 14, wherein said therapy cushion is formed with opposing contoured recesses into which a patient's extremities may be placed while exercising.

16. The therapy cushion according to claim 1, wherein said resilient pad is formed with a peanut-shaped configuration having a central section formed with a contoured recess into which a patient's extremities may be placed while exercising.

17. The therapy cushion according to claim 1, wherein said resilient pad is formed with a substantially rectangular configuration.

18. The therapy cushion according to claim 17, wherein said therapy cushion is formed with opposing contoured recesses into which a patient's extremities may be placed while exercising.

19. The therapy cushion according to claim 1, wherein said prescribed baseline pressure readout on said meter is approximately 100–150 mm Hg.

20. The therapy cushion according to claim 19, wherein said maximum pressure is approximately 30–100 mm Hg greater than said baseline pressure readout.

* * * * *

UNITED STATES PATENT AND TRADEMARK OFFICE

CERTIFICATE OF CORRECTION

PATENT NO. : 7,182,717 B2 
APPLICATION NO. : 10/819561
DATED : February 27, 2007
INVENTOR(S) : Tanglos It is certified that error appears in the above-identified patent and that said Letters Patent is hereby corrected as shown below:

Delete Title page illustrating a figure, and substitute therefor, new Title page illustrating a figure. (attached)

Delete drawing sheets 1-13, and substitute therefor drawing sheets 1-13. (attached0

Signed and Sealed this

Twenty-second Day of May, 2007

JON W. DUDAS
*Director of the United States Patent and Trademark Office*

(12) United States Patent
Tanglos

(10) Patent No.: US 7,182,717 B2
(45) Date of Patent: Feb. 27, 2007

(54) THERAPY CUSHION FOR USE WITH BLOOD PRESSURE CUFF

(76) Inventor: Thomas Alexander Tanglos, 6889 Caravan Ct., Columbia, MD (US) 21044

( * ) Notice: Subject to any disclaimer, the term of this patent is extended or adjusted under 35 U.S.C. 154(b) by 461 days.

(21) Appl. No.: 10/819,561

(22) Filed: Apr. 7, 2004

(65) Prior Publication Data

US 2004/0198570 A1 Oct. 7, 2004

Related U.S. Application Data

(60) Provisional application No. 60/461,066, filed on Apr. 7, 2003.

(51) Int. Cl.
*A63B 21/008* (2006.01)

(52) U.S. Cl. ..... 482/112; 482/121; 482/139

(58) Field of Classification Search ..... 482/112, 482/139, 121, 148; 5/664, 639, 640, 635.3; 128/845; 602/13

See application file for complete search history.

(56) References Cited

U.S. PATENT DOCUMENTS

| | | | | |
|---|---|---|---|---|
| 2,522,120 | A * | 9/1950 | Kaskey et al. | 5/636 |
| 4,528,705 | A * | 7/1985 | Greenawalt | 5/644 |
| 4,772,016 | A * | 9/1988 | Manion | 482/112 |
| 5,005,826 | A * | 4/1991 | Merrick | 482/10 |
| 5,893,366 | A * | 4/1999 | Bzoch | 602/24 |
| 6,327,725 | B1 * | 12/2001 | Vellicus et al. | 5/644 |
| 6,371,894 | B1 * | 4/2002 | Hill | 482/121 |
| 6,413,194 | B1 * | 7/2002 | Gant | 482/112 |

* cited by examiner

*Primary Examiner*—Jerome Donnelly
(74) *Attorney, Agent, or Firm*—Ober/Kaler; c/o Royal W. Craig

(57) ABSTRACT

Disclosed herein is a novel therapy cushion for use in conjunction with a conventional blood pressure cuff. The cuff is inserted into the cushion, and the cushion with inserted cuff is placed between the legs (or against one leg). The cuff is inflated and used as calibrated resistance training device for therapeutic/rehabilitation purposes. The device is especially effective following hip or knee replacement surgery. The manometer (on the blood pressure cuff) serves to indicate resistance level. Other variations are possible for other exercises.

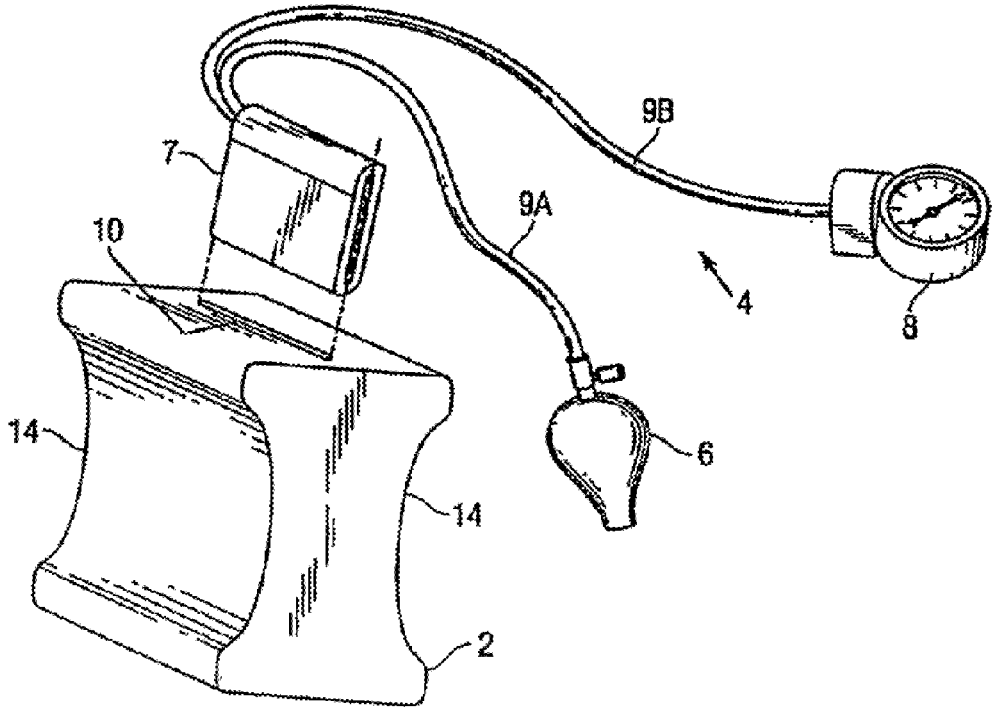

20 Claims, 13 Drawing Sheets